US007273069B1

(12) United States Patent
Nelson

(10) Patent No.: US 7,273,069 B1
(45) Date of Patent: Sep. 25, 2007

(54) PRESSURE ACTIVATED SHUTOFF VALVE

(76) Inventor: Burt Nelson, 32026 Shavox Rd., Salisbury, MD (US) 21804

( * ) Notice: Subject to any disclaimer, the term of this patent is extended or adjusted under 35 U.S.C. 154(b) by 0 days.

(21) Appl. No.: 11/351,145

(22) Filed: Feb. 9, 2006

(51) Int. Cl.
*B65D 83/44* (2006.01)

(52) U.S. Cl. ..... 137/614.2; 137/613; 222/4; 222/396

(58) Field of Classification Search ..... 137/614.2, 137/613; 222/4, 396
See application file for complete search history.

(56) References Cited

U.S. PATENT DOCUMENTS

| | | | | |
|---|---|---|---|---|
| 1,243,068 | A | 10/1917 | Humphrey | |
| 3,327,521 | A | 6/1967 | Briggs | |
| 4,409,817 | A | 10/1983 | Edwards, Jr. | |
| 5,365,772 | A | 11/1994 | Ueda et al. | |
| 5,865,369 | A * | 2/1999 | Fisher et al. | 237/13 |
| 6,196,056 | B1 | 3/2001 | Ewing et al. | |
| 6,286,362 | B1 | 9/2001 | Coffman et al. | |
| 6,418,735 | B1 | 7/2002 | Sienel | |
| 6,550,495 | B1 * | 4/2003 | Schulze | 137/614.2 |
| 6,658,920 | B2 | 12/2003 | Abbel | |
| 7,100,799 | B2 * | 9/2006 | Gruenewald et al. | 222/4 |
| 7,131,560 | B2 * | 11/2006 | Hammond | 222/399 |

FOREIGN PATENT DOCUMENTS

| | | |
|---|---|---|
| DE | 10104207 | 10/2002 |
| JP | 7125796 | 5/1995 |
| JP | 2002037394 | 2/2002 |

* cited by examiner

*Primary Examiner*—Kevin Lee
(74) *Attorney, Agent, or Firm*—Michael I Kroll

(57) ABSTRACT

An apparatus for providing a pressurized gas inline valve assembly incorporating a check valve to maintain pressure above a selectable psi and a ball valve for selectively shutting off gas flow. The apparatus is preferably positioned approximate the gas source in a beverage dispensing system that uses carbon dioxide for carbonation, preservative and propellant. Preferably, the apparatus is designed to maintain the system pressure above the threshold pressure that when below said threshold pressure the carbon dioxide would revert to its inoperative dry ice solid state as opposed to its operative liquid state.

4 Claims, 9 Drawing Sheets

PRESSURE ACTIVATED SHUTOFF VALVE

BACKGROUND OF THE INVENTION

1. Field of the Invention

The present invention relates generally to shutoff valves and, more specifically, to a pressure activated shutoff valve that will maintain a base pressure in a pressurized system thereby maintaining a predetermined critical state to prevent crystallization of a liquified gas, in this case carbon dioxide from reverting to a solid state (dry ice). Furthermore, the present invention provides a manual cut-off switch to sever gas service to remote dispensing modules.

2. Description of the Prior Art

There are other valve devices designed for pressurized systems. Typical of these is U.S. Pat. No. 1,243,068 issued to Humphrey on Oct. 16, 1917.

Another patent was issued to Briggs on Jun. 27, 1967 as U.S. Pat. No. 3,327,521. Yet another U.S. Pat. No. 4,409,817 was issued to Edwards, Jr. on Oct. 18, 1983 and still yet another was issued on Nov. 22, 1994 to Ueda, et al. as U.S. Pat. No. 5,365,772.

Another patent was issued to Ewing, et al. on Mar. 6, 2001 as U.S. Pat. No. 6,196,056. Yet another U.S. Pat. No. 6,286,362 was issued to Coffman, et al. on Sep. 11, 2001. Another was issued to Sienel on Jul. 16, 2002 as U.S. Pat. No. 6,418,735 and still yet another was issued on Dec. 9, 2003 to Abbel as U.S. Pat. No. 6,658,920.

Another patent was issued to Hayakawa on May 16, 1995 as Japanese Patent No. JP7125796. Yet another Japanese Patent No. JP2002037394 was issued to Hosokawa on Feb. 6, 2002. Another was issued to Schneider on Oct. 24, 2002 as German Patent No. DE 10104207.

U.S. Pat. No. 1,243,068

Inventor: Davis Humphrey

Issued: Oct. 16, 1917

A process of producing effervescent beverages, consisting in mixing different fluids in any desired proportions; then carbonating this mixture as produced and finally liquefying the carbonated product in the presence of and under more or less pressure of carbonating gas.

U.S. Pat. No. 3,327,521

Inventor: Walton E. Briggs, et al.

Issued: Jun. 27, 1967

A leak detector having an inlet line connected to a vacuum roughing pump through a first outlet line and first valve means and connected to a mass sensitive member through a second outlet line and second valve means, means for connecting the inlet fine to an hermetically sealed test system, a first toggle joint connected to the first valve means, a second toggle joint connected to the second valve means, each toggle joint having a direction of motion which opens a valve associated with the linkage and a direction of motion which closes the valve, first actuator means for operating the first toggle in the valve opening direction and for operating both toggles in the valve closing direction, second actuator means for simultaneously operating the first toggle in the valve closing direction and the second toggle in the valve opening direction, means for automatically operating the second actuator means in response to the completion of rough vacuum pumping of the inlet line.

U.S. Pat. No. 4,409,817

Inventor: David Edwards, Jr.

Issued: Oct. 18, 1983

Apparatus and method for detecting leakage in a vacuum system involves a moisture trap chamber connected to the vacuum system and to a pressure gauge. Moisture in the trap chamber is captured by freezing or by a moisture adsorbent to reduce the residual water vapor pressure therein to a negligible amount. The pressure gauge is then read to determine whether the vacuum system is leaky. By directing a stream of carbon dioxide or helium at potentially leaky parts of the vacuum system, the apparatus can be used with supplemental means to locate leaks.

U.S. Pat. No. 5,365,772

Inventor: Yasuhiro Ueda, et al.

Issued: Nov. 22, 1994

A reduced pressure processing apparatus includes a processing vessel for performing predetermined processing to an object to be processed in a reduced pressure atmosphere, an exhaust mechanism, including a main exhaust system having a relatively high exhaust pressure and a sub-exhaust system having a relatively low exhaust pressure, for evacuating the processing vessel, and an oxygen gas concentration sensor for detecting an oxygen gas concentration in the processing vessel during exhaust performed by the sub-exhaust system. The oxygen gas concentration in the processing vessel is detected while the processing vessel is evacuated with a relatively low exhaust pressure. It is determined whether leakage is present or absent by confirming a detection value is a predetermined value or less within a predetermined period of time. When leakage is absent, the processing vessel is evacuated with the relatively high exhaust pressure. When leakage is present, the exhaust is interrupted, and necessary processing is performed. When the processing vessel is set in a desired reduced pressure state, predetermined processing is performed to the substrate.

U.S. Pat. No. 6,196,056

Inventor: Fritz Ewing, et al.

Issued: Mar. 6, 2001

A system is provided for detecting a seal fault in units which include sealed gaseous portions. The system includes an electro-negative tracer gas inserter for inserting an electro-negative tracer gas within the sealed portion of the unit, a gas sampler for sampling a flow of gas proximate the object containing the tracer gas and an electron capture detector connected to the gas sampler for monitoring the gas for the presence of the electro-negative test gas. The system thereby determines a presence or absence of the seal fault in the sealed portion of the unit.

U.S. Pat. No. 6,286,362

Inventor: John Daniel Coffman

Issued: Sep. 11, 2001

The present invention generally provides a leak detector having at least two partial pressure analyzers. The leak detector comprises a pumping system, a trace gas detector, and a residual gas analyzer. The leak detector is attachable to a test object, such as a vacuum system, and the pumping system operates to draw a vacuum therein. The residual gas analyzer determines the presence of oxygen, nitrogen, and other components of air in the test object. A trace gas, such as helium, provided to the exterior of the test system is monitored by the trace gas detector which may be a magnetic sector mass spectrometer. The residual gas analyzer and the trace gas detector may be operated simultaneously or independently.

U.S. Pat. No. 6,418,735

Inventor: Tobias H. Sienel

Issued: Jul. 16, 2002

A valve located at the exit of at least one of two circuits in a gas cooler in a vapor compression system controls the high pressure of the system. The high pressure of the system can be regulated by controlling the actuation of the valve. Closing the valve will accumulate and store charge in the gas cooler, increasing the pressure in the gas cooler. Opening the valve will release charge and reduce the gas cooler pressure. By controlling the actuation of the valve, the high pressure component of the system can be regulated, also regulating the enthalpy of the system to achieve optimal efficiency and/or capacity. Carbon dioxide is preferably used as the refrigerant.

U.S. Pat. No. 6,658,920

Inventor: Karl Abbel

Issued: Dec. 9, 2003

A leak detector pump, including a housing having a gas outlet and a plurality of gas inlet unions, components of a high vacuum pump located in the housing, a gas analyzer associated with the housing, a union for introducing test fluid into the housing, a plurality of valve members located in the housing for controlling gas flow, and a plurality of connection elements located in the housing for guiding the gas flow between different components of the leak detector pump.

Japan Patent Number JP7125796

Inventor: Hayakawa Hiroshi, et al.

Issued: May 16, 1995

PURPOSE: To make possible one step connection and disconnection of a hose and contrive the shortening of its overall length by providing a hose connecting means which is connected to a branch connection opening when forced thereinto and is disconnected from this opening when pulled therefrom and a connection locking means. CONSTITUTION: A branch distributor 3 is provided in a position after the passage of gas through each pressure control valve 2 and a packing 4 is fitted in a packing groove 3b of a branch connection opening 3a. A hose connection means 5 has a hose connection opening 5a which is connected to the branch connection opening 3a when forced thereinto and is disconnected from this opening when pulled therefrom. Therefore, the hose can be connected to and disconnected from the branch connection opening 3a by one touch operation, i.e. a mere pushing and pulling of the hose connection means 5. In this way the packing 4 contacts closely with the inner wall of the hose connection opening 5a. Concerning a connection locking means 6, when the hose connection opening 5a is inserted into the branch connection opening 3a, hose connection means connection locking slits 6b are coincided with branch distributor connection locking grooves 6a. Locking pins are then inserted into the grooves to engage the branch distributor and the hose together. Therefore, one touch setting is possible.

Japan Patent Number JP2002037394

Inventor: Hosokawa Tatsuya

Issued: Feb. 8, 2002

PROBLEM TO BE SOLVED: To provide a carbon dioxide pressure-reducing valve of which the usability is improved, and which can facilitate a continuous feeding, and at the same time, which can easily detect the presence/absence of carbon dioxide in a carbon dioxide cylinder. SOLUTION: This carbon dioxide pressure-reducing valve 10 is used for a portable beer server system. The carbon dioxide pressure-reducing valve 10 is equipped with a main body 20 and a cap 40 having a spool body 41. In this case, in the main body 20, a carbon dioxide channel 15 is formed. The cap 40 is attached to the main body 20, and at the same time, the spool body 41 can open/close the carbon dioxide channel 15 of the main body 20. The cap 40 makes the circulation of carbon dioxide in the carbon dioxide channel 15 possible under a state wherein the cap 40 is pressed to the main body 20. At the same time, the cap 40 can be fixed under that state by a holding means. Thus, as soon as a user fixes the cap to the main body, the user can remove his hand, and keeping the state wherein the cap is being pressed is not required. As a result, the usability is improved, and at the same time, a continuous feeding becomes easier.

German Patent Number DE10104207

Inventor: Schneider Friedrich

Issued: Oct. 24, 2002

In a drinks manufacturing process, compressed oxygen is released and admixed to water under pressure and dissolving at least 75 mg/l to impregnate the drink for therapeutic purposes. Prior to oxygenation, all gas is removed from the drink. The drink is chilled to less than 18 C. pref. 7 C. Compressed oxygen is released at a pressure of pref. 1 to 7 bar, mixed with compressed $CO_2$ in a ratio of between 2% oxygen to 98% carbon dioxide and 50% to 50%, pref. 25 to 75% by volume. The gas mixture is held in a buffer tank at up to 10 bar, from which it is surrendered to and mixed with the drink. Also claimed is a suitable assembly with a compressed oxygen tank (32), liquid/gas mixer (30) and buffer tank (32). The oxygen uptake is pref. more than 300 mg/l. With a suitable dosing unit, the process and assembly are also suitable for preparation of syrup drink.

While these devices may be suitable for the purposes for which they were designed, they would not be as suitable for the purposes of the present invention, as hereinafter described.

SUMMARY OF THE PRESENT INVENTION

In the market of beverage sales (i.e. sodas, draft beer) carbon dioxide is required for carbonation, preservative and propellant. There are two main forms of providing product to the customer. One is high pressure cylinders. The other is by installing a mini-bulk dewar vessel.

This dewar vessel is designed to convert liquid $CO_2$ into a vapor which is supplied to the beverage system(s). The dewars come in sizes ranging from 200 to 600 lbs. They are filled much the same as propane tanks at a home or business. A tanker truck can hook up to the dewar and fill as needed.

In order to remain in a liquid form, carbon dioxide must be stored in a sealed, vacuum insulated container and maintain an internal head pressure of 59 psi or higher. If head pressure falls below 59 psi. The liquid $CO_2$ will convert into a solid (dry ice) leaving the customer without $CO_2$ vapor needed for beverage system(s). Causes for such loss in head pressure are normally caused by sudden leaks in one or more of the devices using $CO_2$ vapor to deliver/produce product rapidly dropping the pressure in the dewar.

The dewars are designed with an internal pressure builder to maintain a constant pressure but, in most cases the leak in the system is stronger than the ability of the pressure builder causing the dewar to ice (term used in the trade). There is only one way to de-ice the dewar back to normal state. This is by isolating said leak and providing $CO_2$ vapor back into the dewar, converting the dry ice back into a liquid form. This can only be done by the $CO_2$ supplier sending a $CO_2$ tanker truck to the customer location and flow vapor back into the vessel. This results in lost time and money both for the customer and the supplier.

The present invention is designed to stop flow of $CO_2$ vapor from dewar at a set pressure (@ 75 psi+/−10%) which will alert the user of a system failure but prevent service calls to de-ice dewar.

Installed in-line approximate the carbon dioxide source, the device uses a spring pressure seating plug. The tension applied to the plug would stop flow and is adjustable to create desired psi cut off point.

Additionally, the present invention provides a ball valve on the exit end to allow user to close. Allowing dewar to rebuild required pressure in dewar until beverage vendor(s) can locate and repair leak.

The user will be alerted by having sodas low carbonated (flat). The soda systems in use today can require up to 110 psi to operate properly. The user will contact $CO_2$ supplier who will troubleshoot problem over the phone and instruct the user to close ball valve and call beverage vendor(s). This will save $CO_2$ supplier and user great cost by preventing service calls related to outside vendor equipment failure. After repairs have been completed by outside vendor, the ball valve can be opened to restore $CO_2$ vapor flow. Preferably, the device is proceed with a working range of 68 to 82 psi, which will be perfect to alert user's of problems and prevent icing of dewar.

A primary object of the present invention is to provide means for preventing a pressurized carbon dioxide state change from a liquid to a solid within a beverage dispensing system.

Another object of the present invention is to provide said preventing means in the form of a valve.

Yet another object of the present invention is to position said valve approximate the pressurized gas source to gate the beverage dispensing modules from the gas source to prevent depressurization of the source below a predetermined pressure.

Still yet another object of the present invention is to provide for a distribution system having a plurality of depressurization valves and a plurality of respective containerized liquid state carbon dioxide sources.

Another object of the present invention is to provide said valve with a spring tensioned bore orifice seat incorporating means for varying the pressure applied thereto.

Yet another object of the present invention is to provide said valve with exterior control means for varying the operative automatic minimum shut-off pressure.

Still yet another object of the present invention is to provide said valve with a manual operably downstream shut-off valve to disconnect the source from the dispensing modules.

Additional objects of the present invention will appear as the description proceeds.

The present invention overcomes the shortcomings of the prior art by providing a pressure activated shutoff valve that will maintain a base pressure in a pressurized system. thereby maintaining a predetermined critical state to prevent crystallization of a liquified gas, in this case carbon dioxide from reverting to a solid state (dry ice). Furthermore, the present invention provides a manual cut-off switch to sever gas service to remote dispensing modules.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now descriptively to the drawings, in which similar reference characters denote similar elements throughout the several views, the Figures illustrate the portable work-surface of the present invention. With regard to the reference numerals used, the following numbering is used throughout the various drawing Figures.

10 Pressure Activated Shutoff Valve
12 pressurized beverage dispensing system
14 beverage supply
16 gas supply line
18 gas source
20 pressure limiter ingress nipple
22 ingress nipple throughbore
24 ingress nipple male feed line threads
26 ingress nipple receptacle
28 female pipe threads of ingress nipple receptacle

30 nipple regulator coupling
32 coupling bore
34 coupling exterior male threads
36 coupling receptacle
38 coupling receptacle female threads
40 pressure regulator
42 pressure regulator bore
44 pressure regulator exterior male pipe threads
46 pressure regulator egress receptacle
48 female pipe threads of pressure regulator egress receptacle
50 reducer bushing
52 reducer bushing bore
54 exterior ingress reducer bushing male pipe threads
56 reducer bushing egress receptacle
58 female pipe threads of reducer bushing egress receptacle
60 shutoff valve
62 shutoff valve ball valve
64 shutoff valve check valve
66 shutoff valve bore
68 shutoff valve exterior ingress male pipe threads
70 shut off valve handle
72 shut off valve egress nipple male pipe threads
74 shut off valve egress nipple

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
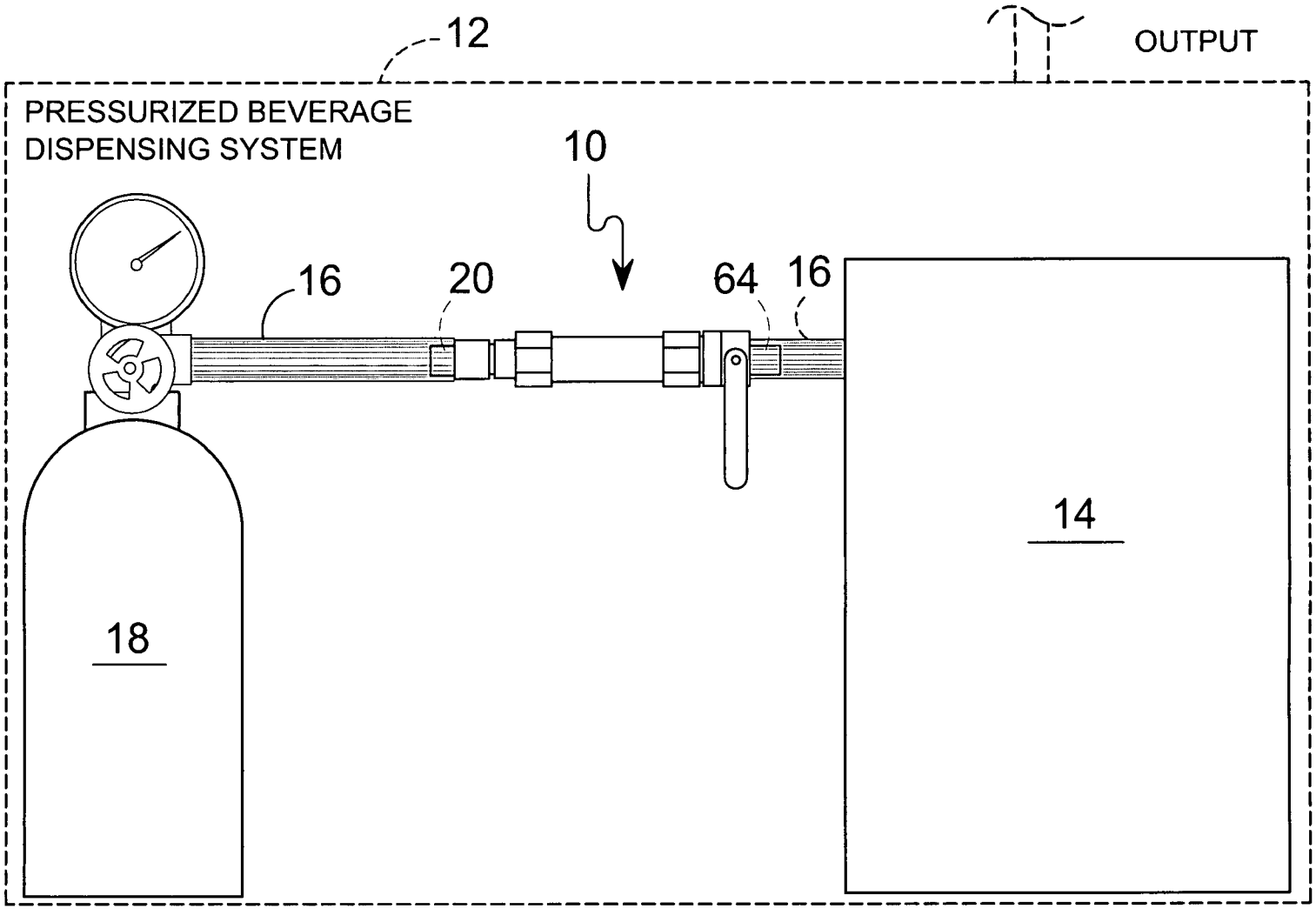
FIG. 1 is a flow diagram of the present invention.

Referring to FIG. 1, shown is a flow diagram of the present invention. Depicted is a flow diagram of the pressure activated shutoff value 10 for a pressurized beverage dispensing system 12 of the present invention. The pressure activated shutoff valve 10 is positioned within gas supply line 16 extending between gas source 18 and beverage source 14 using nipple 20 and 74. Once positioned therein the apparatus 10 will maintain a base pressure in a pressurized system, thereby maintaining a predetermined critical state to prevent crystallization of a liquified gas 18, in this case carbon dioxide from reverting to a solid state (dry ice). Furthermore, the present invention provides a manual cut-off switch 70 to sever gas service to remote dispensing modules.

Figure 2:
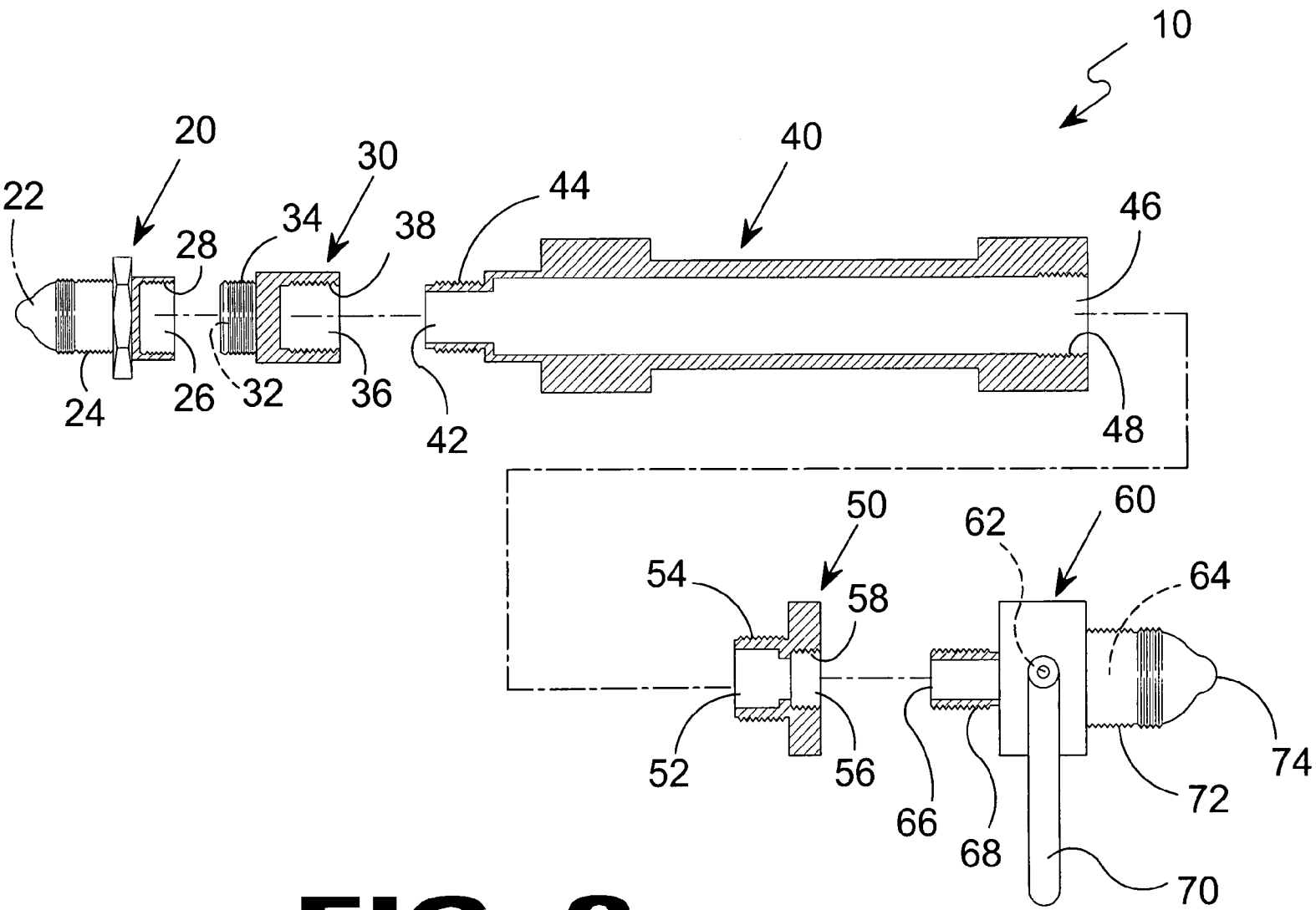
FIG. 2 is an exploded sectional view of the pressure activated shutoff valve.

Referring to FIG. 2, shown is an exploded sectional view of the pressure activated shutoff valve. The valve apparatus is designed to prevent depressurization of a pressurized beverage dispensing system 12 by establishing a threshold pressure below which the valve will automatically close maintaining a predetermined pressure to prevent the liquid carbon dioxide from a state change from a liquid to a solid. The pressure activated shutoff valve 10 is comprised of a pressure limiter ingress nipple 20 having ingress nipple throughbore 22 with ingress nipple male feed line threads 24 for mounting to gas supply line 16. The nipple 20 also has receptacle 26 with interior female threads 28, which when assembled matingly engage nipple regulator coupling 30. Coupling 30 has coupling bore 32 with the aforemention exterior male threads 34 for mounting the ingress nipple 20 thereon. At the opposite end coupling 30 has a receptacle 36 with interiorly positioned female threads 38 for attaching to pressure regulator 40. Pressure regulator 40 incorporates means for preventing discharge of the gas 16 below a predetermined pressure threshold. The regulator 40 has throughbore 42 and exterior male threads 44 that matingly engage receptacle 36 and held therein by female threads 38. on the other end of regulator 40 resides pressure regulator egress receptacle 46 having female pipe threads 48 for mounting reducer bushing 50 therein. Reducer busing 50 is comprised of reducer busing bore 52 having exteriorly mounted male threads 54 for attaching the reducer bushing 50 to pressure regulator 50. at the opposing end of bushing 50, receptacle 56 has female threads 58 for mounting shutoff valve 60. Shutoff valve 60 incorporates ball valve 62 and check valve 62 preventing back flow and providing means for terminating gas discharge from gas source 18 using manually rotatable handle 70. Shutoff valve 60 has throughbore 66 and has exterior male threads 68 matingly engageable with busing 50 female threads 58 at the other end of shutoff valve 60 is nipple 72 having exterior male threads for fastening to gas line 16 extending from gas source 18.

Figure 3:
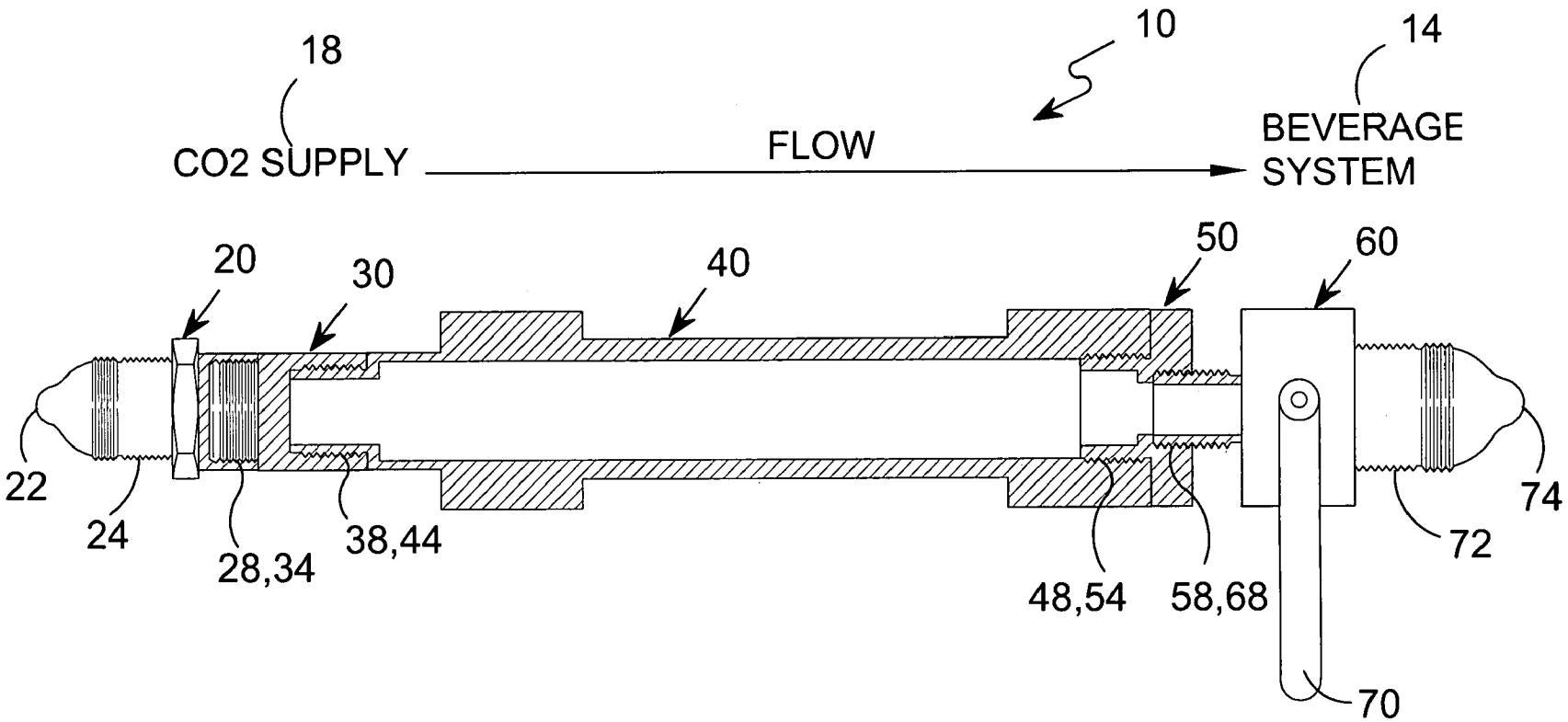
FIG. 3 is an assembled sectional view of the pressure activated shutoff valve.

Referring to FIG. 3, shown is an assembled sectional view of the pressure activated shutoff valve. The valve apparatus is designed to prevent depressurization of a pressurized beverage dispensing system 12 by establishing a threshold pressure below which the valve will automatically close maintaining a predetermined pressure to prevent the liquid carbon dioxide from a state change from a liquid to a solid. The pressure activated shutoff valve 10 is comprised of a pressure limiter ingress nipple 20 having ingress nipple throughbore 22 with ingress nipple male feed line threads 24 for mounting to gas supply line 16. The nipple 20 also has the aforementioned receptacle 26 with interior female threads 28, which when assembled matingly engage nipple regulator coupling 30 via threads 34. Coupling 30 has coupling bore 32 with the aforemention exterior male threads 34 for mounting the ingress nipple 20 thereon creating mating engagement 28, 34. At the opposite end coupling 30, receptacle 36 with interiorly positioned female threads 38 are matingly engaged with pressure regulator 40 via male threads 44 creating mating engagement 38, 44. Pressure regulator 40 incorporates means for preventing discharge of the gas 16 below a predetermined pressure threshold. On the other end of regulator 40 resides pressure regulator egress receptacle 46 having female pipe threads 48 for mounting reducer bushing 50 therein creating mating engagement 48, 54. Reducer busing 50 also has receptacle 56 with female threads 58 for mounting shutoff valve 60 via male threads 68 forming mating engagement 58, 68. Shutoff valve 60 incorporates ball valve 62 and check valve 62 preventing back flow and providing means for terminating gas discharge from gas source 18 using manually rotatable handle 70. Shutoff valve 60 also has nipple 72 with exterior male threads 72 for fastening to gas line 16 extending from gas source 18.

Figure 4:
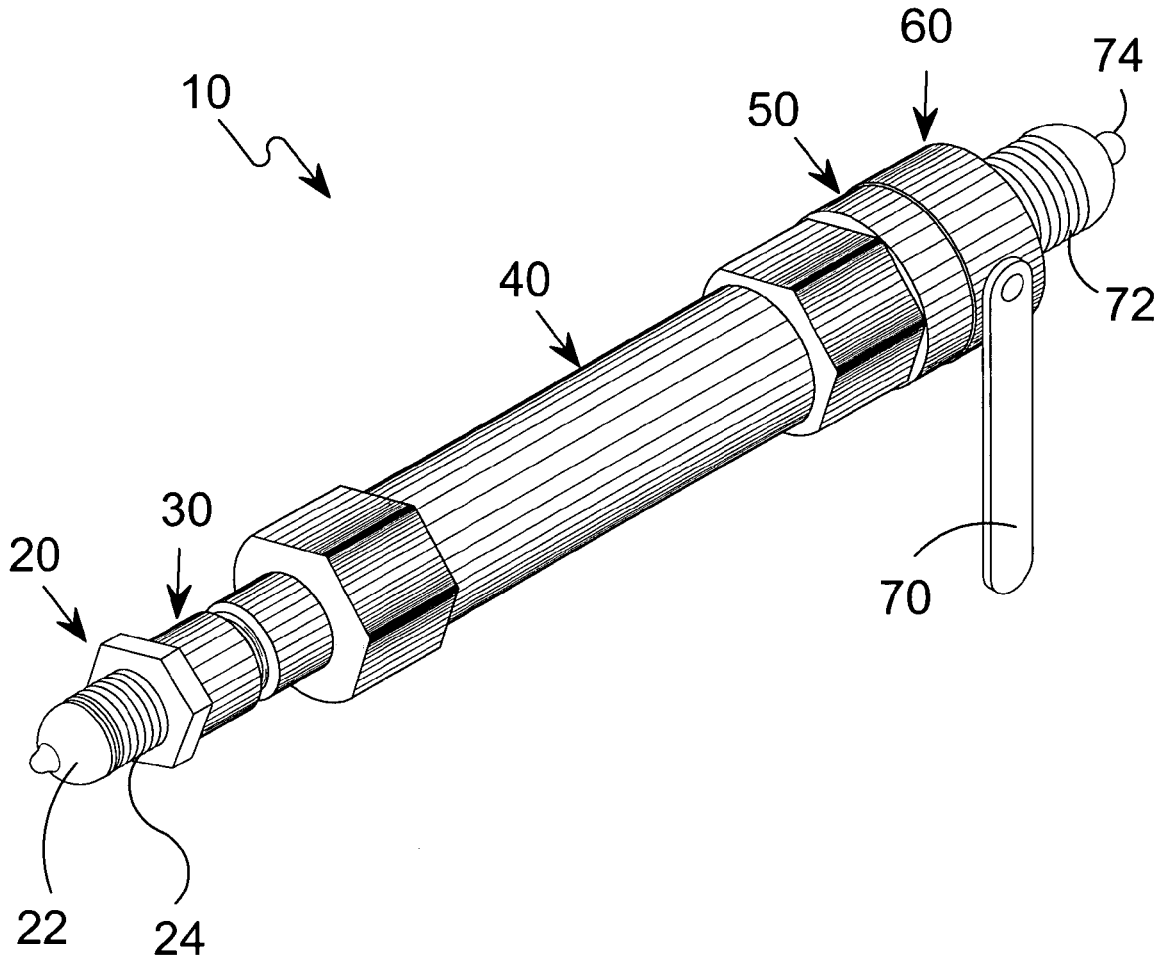
FIG. 4 is a perspective view of the pressure activated shutoff valve of the present invention.

Referring to FIG. 4, shown is a perspective view of the pressure activated shutoff valve of the present invention. The valve apparatus is designed to prevent depressurization of a pressurized beverage dispensing system by mounting the apparatus within the gas supply line 16, which will prevent depressurization of the system by establishing a threshold pressure below which the valve will automatically close. The pressure activated shutoff valve 10 is comprised of a pressure limiter ingress nipple 20 having ingress nipple throughbore 22 with ingress nipple male feed line threads 24 for mounting to gas supply line 16. Coupling 30 is mounted to pressure limiter ingress nipple 20, which in turn is mounted to pressure regulator 40. Pressure regulator 40 has reducer bushing 50 mounted on the other end with shutoff valve 60 threadedly fastened thereto. Shutoff valve 60 incorporates ball valve 62 and check valve 64 preventing back flow and providing means for terminating gas discharge from gas source 18 using manually rotatable handle 70. Shutoff valve 60 also has nipple 72 with exterior male threads 72 for fastening to gas line 16 in communication with gas source 18.

Figure 5:
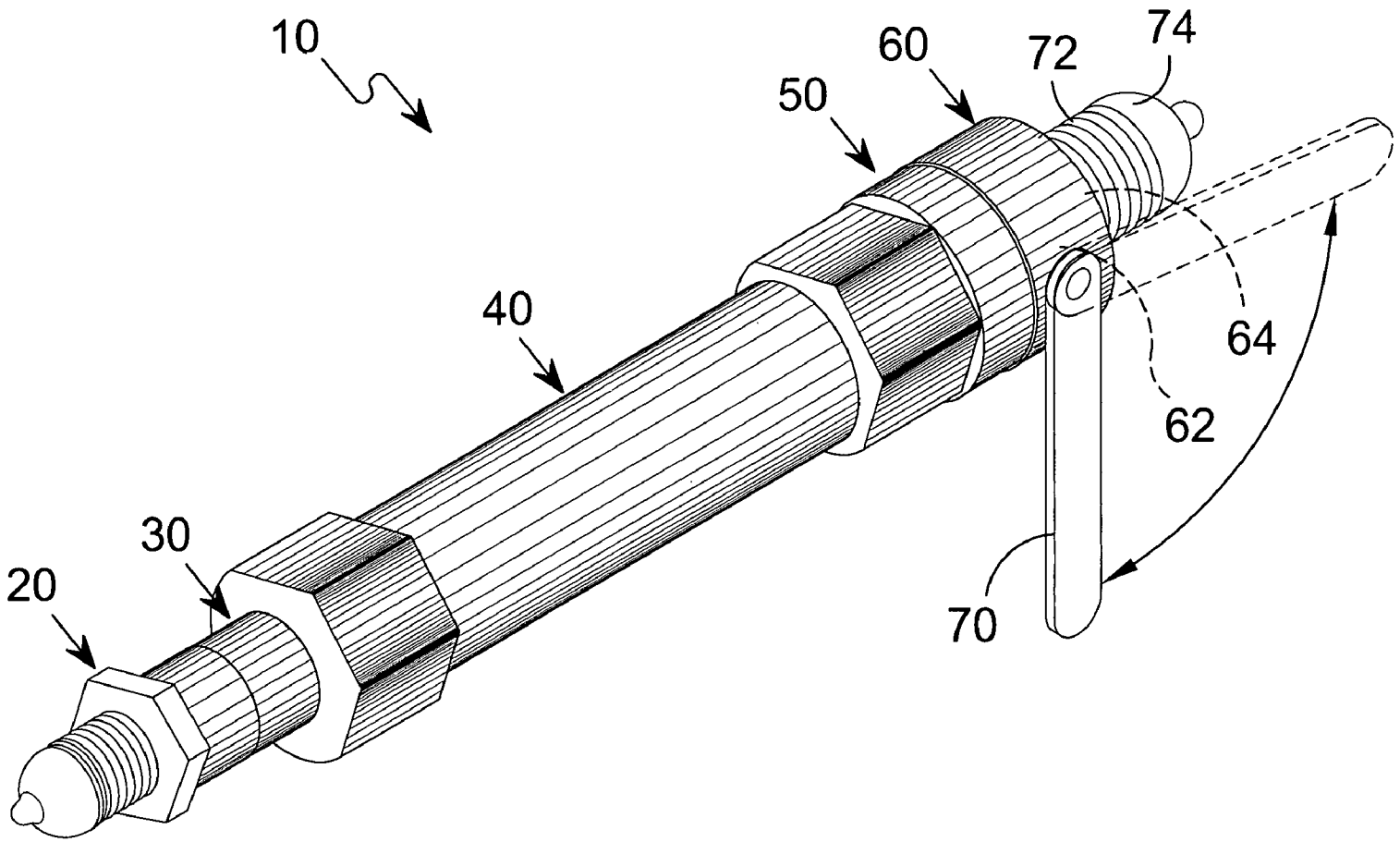
FIG. 5 is a perspective view of the pressure activated shutoff valve of the present invention depicting shutoff valve ball valve in an open and closed state.

Referring to FIG. 5, shown is a perspective view of the pressure activated shutoff valve of the present invention depicting shutoff valve ball valve 62 being closed by rotating valve handle 70 from the open to closed position. The valve apparatus is designed to prevent depressurization of a pressurized beverage dispensing system by mounting the apparatus within the gas supply line 16, which will prevent depressurization of the system by establishing a threshold pressure below which the valve will automatically close. The pressure activated shutoff valve 10 is comprised of a pressure limiter ingress nipple 20 having ingress nipple throughbore 22 with ingress nipple male feed line threads 24 for mounting to gas supply line 16. Coupling 30 is mounted to pressure limiter ingress nipple 20, which in turn is mounted to pressure regulator 40. Pressure regulator 40 has reducer bushing 50 mounted on the other end with shutoff valve 60 threadedly fastened thereto. Shutoff valve 60 incorporates ball valve 62 and check valve 64 preventing back flow and providing means for terminating gas discharge from gas source 18 using manually rotatable handle 70. Shutoff valve 60 also has nipple 72 with exterior male threads 72 for fastening to gas line 16 in communication with gas source 18.

Figure 6:
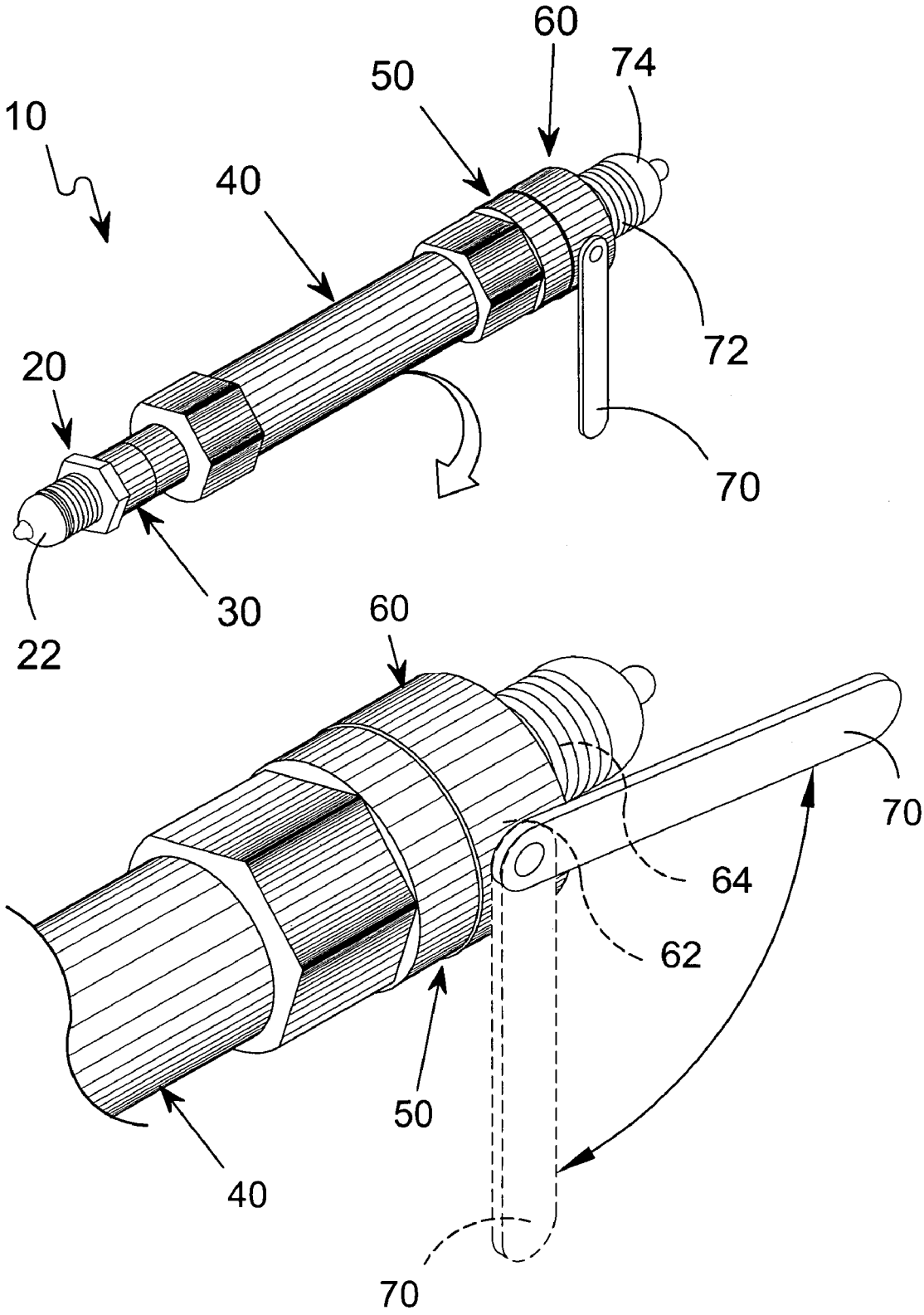
FIG. 6 is an enlarged view of the shutoff valve handle moved from an open to closed position.

Referring to FIG. 6, shown is an enlarged view of the shutoff valve handle moved from an open to closed position. As previously stated, The valve apparatus is designed to prevent depressurization of a pressurized beverage dispensing system 12 by mounting the apparatus 10 within the gas supply line 16, which will prevent depressurization of the system by establishing a threshold pressure below which the valve will automatically close via pressure regulator 40. The pressure activated shutoff valve 10 is comprised of a pressure limiter ingress nipple 20 having coupling 30 mounted thereon and in turn mounted to pressure regulator 40. Pressure regulator 40 has reducer bushing 50 mounted on the other end with shutoff valve 60 threadedly fastened thereto. Shutoff valve 60 incorporates ball valve 62 and check valve 64, which prevents back flow. As desired, gas discharge can be terminated using manually rotatable handle 70.

Figure 7:
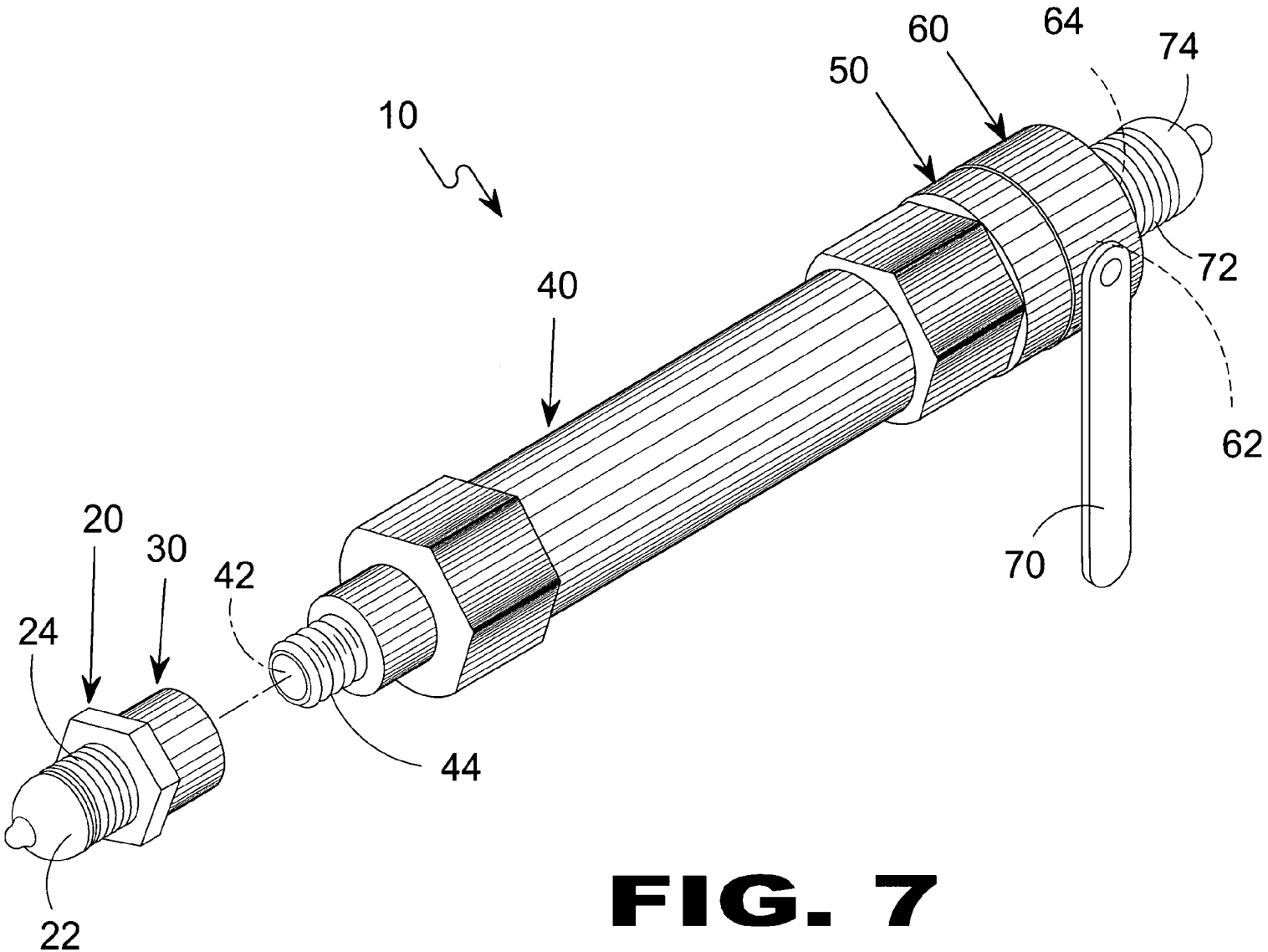
FIG. 7 is a perspective view of the pressure activated shutoff valve of the present invention having pressure limiter ingress nipple and nipple regulator coupling removed.

Referring to FIG. 7, shown is a perspective view of the pressure activated shutoff valve of the present invention having pressure limiter ingress nipple and nipple regulator coupling removed. As illustrated, the pressure activated shutoff valve 10 has pressure limiter ingress nipple 20 with throughbore 22 mounted to coupling 30, which in turn is mountable to pressure regulator 40 via Threads 44. Pressure regulator 40 has reducer bushing 50 mounted on the other end along with shutoff valve 60, which incorporates ball valve 62 providing means for terminating gas discharge from gas source 18 using manually rotatable handle 70. Shutoff valve 60 also has nipple 74 with exterior male threads 72 for fastening to gas line 16, which operatively is in communication with gas source 18.

Figure 8:
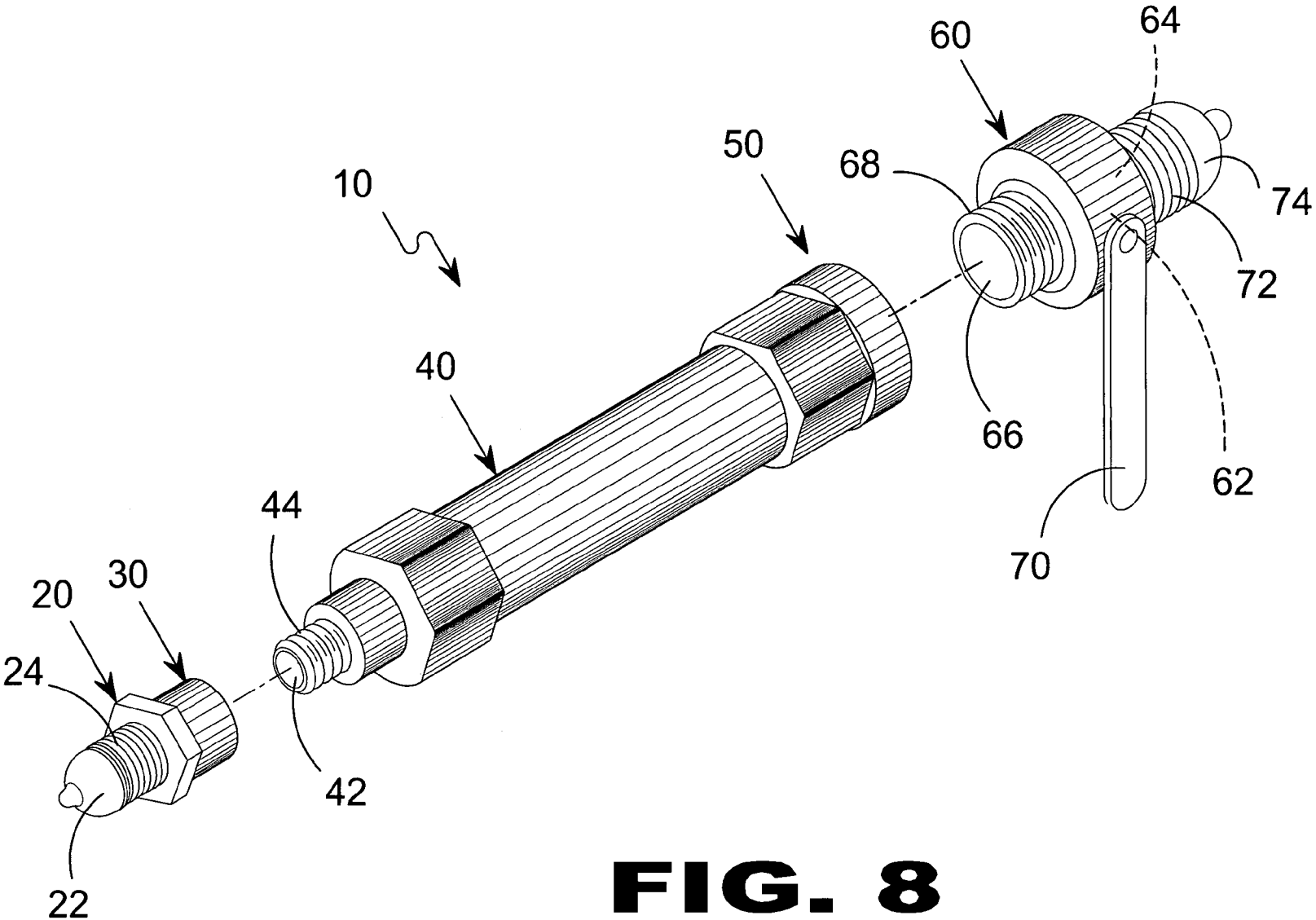
FIG. 8 is a perspective view of the pressure activated shutoff valve of the present invention having pressure limiter ingress nipple and nipple regulator coupling removed, along with the shutoff valve.

Referring to FIG. 8, shown is a perspective view of the pressure activated shutoff valve of the present invention having pressure limiter ingress nipple and nipple regulator coupling removed, along with the shutoff valve 60. As illustrated, the pressure activated shutoff valve 10 has pressure limiter ingress nipple 20 with throughbore 22 mounted to coupling 30, which in turn is mountable to pressure regulator 40 via threads 44. Pressure regulator 40 has reducer bushing 50 mounted on the other end along with shutoff valve 60, which incorporates ball valve 62 providing means for terminating gas discharge from gas source 18 using manually rotatable handle 70. Shutoff valve 60 also has nipple 724 with exterior male threads 72 for fastening to gas line 16, which operatively is in communication with gas source 18.

Figure 9:
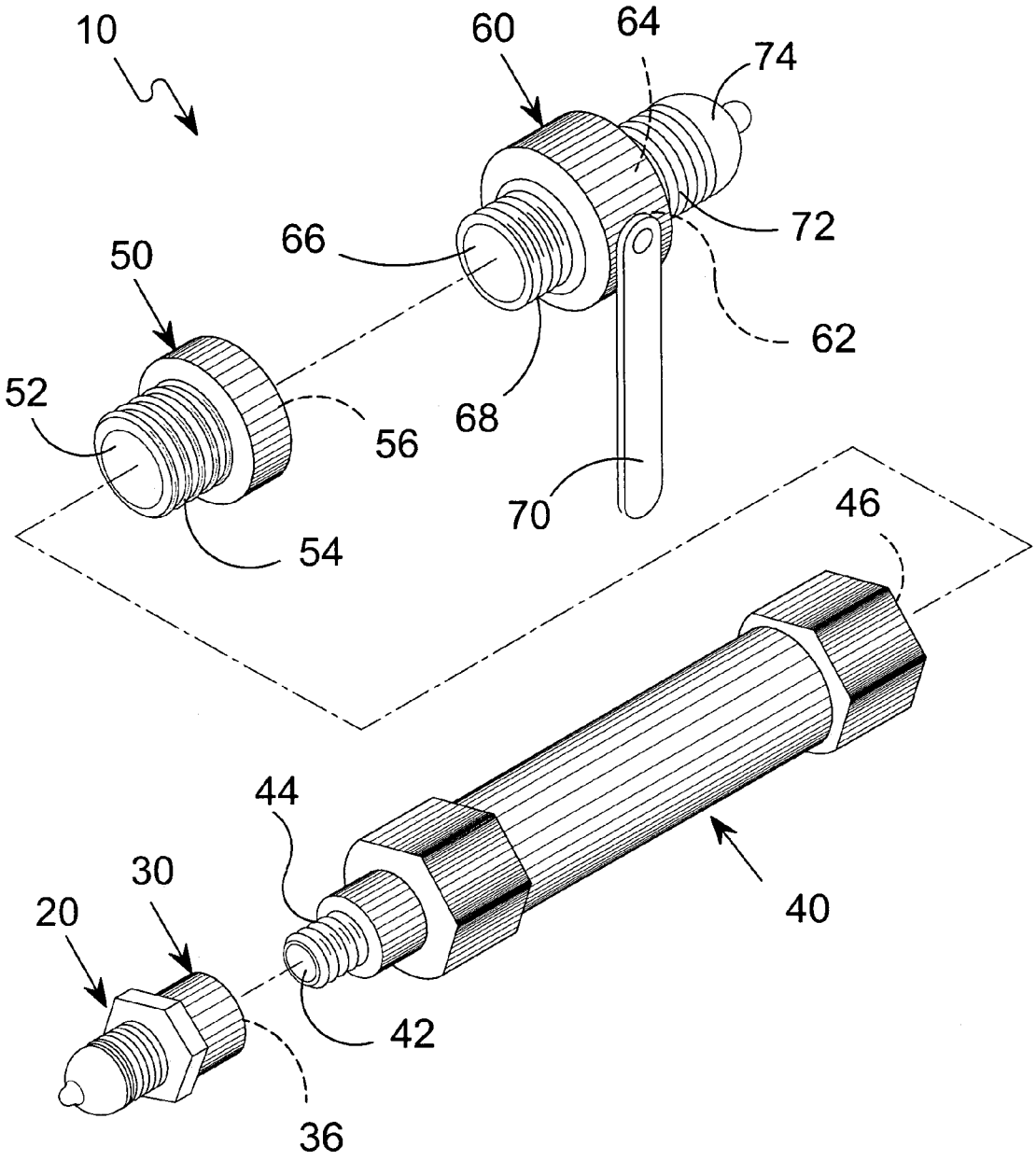
FIG. 9 is an exploded view of the pressure activated shutoff valve.

Referring to FIG. 9, shown is an exploded view of the pressure activated shutoff valve. The valve apparatus is designed to prevent depressurization of a pressurized beverage dispensing system 12 by establishing a threshold pressure below which the valve will automatically close maintaining a predetermined pressure to prevent the liquid carbon dioxide from a state change from a liquid to a solid. The pressure activated shutoff valve 10 is comprised of a pressure limiter ingress nipple 20 having ingress nipple throughbore 22 with ingress nipple male feed line threads 24 for mounting to gas supply line 16. The nipple 20 also has receptacle 26 with interior female threads 28, which when assembled matingly engage nipple regulator coupling 30. Coupling 30 has coupling bore 32 with the aforemention exterior male threads 34 for mounting the ingress nipple 20 thereon. At the opposite end coupling 30 has a receptacle 36 with interiorly positioned female threads 38 for attaching to pressure regulator 40. Pressure regulator 40 incorporates means for preventing discharge of the gas 16 below a predetermined pressure threshold. The regulator 40 has throughbore 42 and exterior male threads 44 that matingly engage receptacle 36 and held therein by female threads 38 on the other end of regulator 40 resides pressure regulator egress receptacle 46 having female pipe threads 48 for mounting reducer bushing 50 therein. Reducer busing 50 is comprised of reducer busing bore 52 having exteriorly mounted male threads 54 for attaching the reducer bushing 50 to pressure regulator 50 at the opposing end of bushing 50, receptacle 56 has female threads 58 for mounting shutoff valve 60. Shutoff valve 60 incorporates ball valve 62 and check valve 62 preventing back flow and providing means for terminating gas discharge from gas source 18 using manually rotatable handle 70. Shutoff valve 60 has through-bore 66 and has exterior male threads 68 matingly engageable with busing 50 female threads 58 at the other end of shutoff valve 60 is nipple 72 having exterior male threads for fastening to gas line 16 extending from gas source 18.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A valve apparatus within a gas line of a pressurized system for limiting pressure loss in a gas source comprising:

a) a housing member;

b) said housing member being within said gas line of said pressurized system, said gas line connected to said gas source;

c) the housing member incorporating a pressure regulator;

d) said pressure regulator terminating gas flow through said housing member from said gas source when pressure within said pressurized system drops below about 75 psi as a warning to a user in order to prevent the pressure to drop below 59 psi; and e) said housing member having an ingress nipple on one end having exterior threads for attached to said gas line with interior pipe threads, a nipple regulator coupling between said ingress nipple and said housing member having male pipe threads diametrically sized for mating to said nipple regulator coupling, said housing member having a receptacle with female pipe threads on an opposing end thereof, a reducer bushing housing having a bore with exterior pipe threads on one end diametrically sized for engaging said housing member female receptacle threads, said reducer bushing having a receptacle on an opposing end with female pipe threads, a shutoff valve having a nipple on one end with exterior male pipe threads diametrically sized to mate with the reducer bushing female receptacle, and a main feedline nipple on an opposite end of said shutoff valve having exterior male threads for attached to said gas line, said shutoff valve incorporating a manually operated shutoff ball valve and a means for preventing backflow in said gas line.

2. The apparatus of claim 1, wherein said means for manually terminating gas flow incorporates an externally rotatable handle for moving the ball valve between an open and closed state.

3. The apparatus as recited in claim 2, wherein said means for preventing backflow is a check valve.

4. A pressurized beverage dispensing system comprising:

a) a beverage source;

b) a source of pressurized carbon dioxide;

c) a gas supply line for delivering pressurized carbon dioxide to said beverage source from said source of pressurized carbon dioxide;

d) a pressure activated shutoff valve within a housing within said gas supply line for preventing a pressurized carbon dioxide state change from a liquid to a solid due to a loss of pressure within said dispensing system;

e) a manual shutoff valve in said gas supply line between said pressure activated shutoff valve and said beverage source;

f) said pressure activated shutoff valve restricting gas flow through said housing when pressure within said dispensing system drops below a predetermined threshold value of about 75 psi as a warning to a user in order to prevent the pressure to drop below 59 psi.

* * * * *